US011760563B2

(12) United States Patent
Suh et al.

(10) Patent No.: US 11,760,563 B2
(45) Date of Patent: Sep. 19, 2023

(54) FOLDABLE CONTAINER

(71) Applicant: KOREA PALLET POOL CO., LTD, Seoul (KR)

(72) Inventors: Byong Yoon Suh, Seoul (KR); Yong Jun Lee, Cheonan-si (KR); Shin Joon Kang, Osan-si (KR); Nu Ree Lee, Seoul (KR)

(73) Assignee: Korea Pallet Pool Co., Ltd, Seoul (KR)

( * ) Notice: Subject to any disclaimer, the term of this patent is extended or adjusted under 35 U.S.C. 154(b) by 175 days.

(21) Appl. No.: 17/425,085

(22) PCT Filed: May 14, 2019

(86) PCT No.: PCT/KR2019/005762
§ 371 (c)(1),
(2) Date: Jul. 22, 2021

(87) PCT Pub. No.: WO2020/153535
PCT Pub. Date: Jul. 30, 2020

(65) Prior Publication Data

US 2022/0106107 A1 Apr. 7, 2022

(30) Foreign Application Priority Data

Jan. 23, 2019 (KR) ..... 10-2019-0008556

(51) Int. Cl.
*B65D 88/02* (2006.01)
*B65D 88/52* (2006.01)

(52) U.S. Cl.
CPC ..... *B65D 88/522* (2013.01)

(58) Field of Classification Search
CPC ..... B65D 88/52; B65D 88/522; B65D 88/121
(Continued)

(56) References Cited

U.S. PATENT DOCUMENTS 3,612,330 A * 10/1971 Baer ..... B65D 88/524 74/89.22
3,765,556 A * 10/1973 Baer ..... B65D 88/022 220/6

(Continued)

FOREIGN PATENT DOCUMENTS

DE 2617773 A1 11/1976
DE 3406461 A1 8/1984

(Continued)

*Primary Examiner* — John K Fristoe, Jr.
*Assistant Examiner* — Elizabeth J Volz
(74) *Attorney, Agent, or Firm* — Rabin & Berdo, P.C.

(57) ABSTRACT

The present disclosure relates to a foldable container including a bottom plate, a top plate, and side wall panels provided between the bottom plate and the top plate, in which the side wall panels include a front panel, a rear panel, a first side panel, and a second side panel, and the container includes first and second torsion bars respectively provided at lower ends of the first and second side panels to generate torque when the first and second side panels are rotated, third and fourth torsion bars respectively provided at lower ends of the front panel and the rear panel to generate torque when the front panel and the rear panel are rotated, and a first rotation support member having an L-shape, including one end coupled to a post coupling point (220) spaced apart by a predetermined distance from the lower end of the front panel, and the other end coupled to a third torsion bar at a bottom plate coupling point (210) located on a side spaced apart by a predetermined distance from an end of the bottom plate to support the rotation operation of the front panel, in which the top plate is completely detachably coupled to the side wall panel.

8 Claims, 13 Drawing Sheets

(58) Field of Classification Search
USPC ..... 220/1.5, 6
See application file for complete search history.

(56) References Cited

U.S. PATENT DOCUMENTS

| | | | | |
|---|---|---|---|---|
| 9,932,169 | B2 * | 4/2018 | Kraft | B65D 88/522 |
| 2007/0194017 | A1 * | 8/2007 | Markwell | B65D 88/126 220/1.5 |
| 2007/0215568 | A1 | 9/2007 | Heinrichs et al. | |
| 2008/0135545 | A1 * | 6/2008 | Sadkin | B65D 88/524 220/1.5 |
| 2010/0147728 | A1 * | 6/2010 | Guiles | B65D 90/047 206/521 |
| 2010/0264137 | A1 * | 10/2010 | Lampe | B29C 41/06 220/651 |
| 2014/0231422 | A1 * | 8/2014 | Kochanowski | E05D 11/1007 220/1.5 |
| 2014/0263306 | A1 * | 9/2014 | Brennan, Jr. | B65D 90/0026 16/221 |
| 2016/0251153 | A1 * | 9/2016 | Navalon Simon | B65D 88/522 220/1.5 |
| 2017/0021999 | A1 | 1/2017 | Pawluk | |

FOREIGN PATENT DOCUMENTS

| | | | |
|---|---|---|---|
| KR | 10-1064803 | B1 | 9/2011 |
| KR | 10-1439073 | B1 | 9/2014 |
| KR | 10-1489626 | B1 | 2/2015 |

* cited by examiner

FOLDABLE CONTAINER

BACKGROUND

Technical Field

The present disclosure relates to a foldable container that can be folded by use of a torsion bar, and specifically, to a technology for folding a container in ¼ in a height direction by including a torsion bar provided at a lower end of a side wall panel of the container, and removing a top plate so as to easily fold the side wall panel, and then re-coupling the top plate.

Background Art

In general, a container has a shape of a large box formed of metal plates and is mainly used for cargo transportation. Such a container is sized according to a certain standard and is widely used for its advantage that it not only allows ease of cargo storage and transport, but also can protect the cargo loaded therein. Containers are transported individually by dedicated large cargo vehicles or transported in large quantities by a dedicated train or a dedicated vessel. However, when transported by the modes of transport, whether the containers are loaded with cargo or empty without cargo therein, they occupy the same space of transport.

Therefore, when the containers without the cargo loaded therein are transferred to another place or stored in a certain place, the containers in their fixed volume cause a problem that they unnecessarily occupy a large volume, thus taking a large amount of transportation space and transportation costs. In other words, after the containers loaded with the cargo have transported the cargo, when they are stored or retrieved in empty state, the containers with such invariable volume take up a large amount of space and costs for storage and transportation.

In particular, when transferring a container using a large cargo vehicle, since one container is mounted on one cargo vehicle and transported, transportation efficiency may decrease and transportation cost may greatly increase. In addition, since the container occupies a very large amount of space, when several containers are stacked, there is a risk of an accident due to the height of the stacked containers.

In order to improve this, in the related art, a foldable container that can save stacking space and can be folded for easy and convenient transportation of empty containers has been disclosed.

A foldable container according to the related art has been disclosed in Korean Patent Publication No. 10-1064803, Korean Patent Publication No. 10-1439073, and Korean Patent Publication No. 10-1489626. Referring to these, both side plates between the bottom plate and the roof plate are configured as an upper plate and a bottom plate, in which the upper plate and the bottom plate, the upper plate and the roof plate, and the bottom plate and the bottom plate are pivotally coupled to each other by a plurality of hinge devices so as to be folded to each other. Such a hinge device is configured to include hinge blocks provided on each of the plates folded to each other, and connection blocks for connecting these hinge blocks, in which the hinge blocks and the connection blocks are hingedly coupled through hinge pins respectively.

However, since the foldable container according to the related art includes, for the hinge device, the hinge blocks installed on each of the plates to be folded to each other, the connecting blocks connecting the respective hinge blocks, and the hinge pins that hingedly couple the respective hinge blocks and the connecting blocks, there are shortcomings that the entire structure of the hinge device is complex, heavy, and not easy to manufacture and mount.

SUMMARY

Technical Problem

In order to solve the problems of the related art described above, an object of the present disclosure is to provide a structure that allows the side walls of a foldable container to be easily folded by manpower.

In addition, another object of the present disclosure is to provide a method of folding a side wall of a container while a top plate is removed, with a structure for folding a side wall of a container, in which the method includes placing a torsion bar at a lower end of a side wall panel and utilizing the torque of the torsion bar to allow the side wall to be smoothly folded.

In addition, an object of the present disclosure is to facilitate the folding and unfolding of the side wall by accumulating elastic force in the torsion bar during the process of folding the side wall of the container and utilizing the accumulated elastic energy in the process of unfolding the side wall of the container.

Technical Solution

The present disclosure relates to a foldable container including a bottom plate, a top plate, and side wall panels provided between the bottom plate and the top plate, in which the side wall panels include a front panel, a rear panel, a first side panel, and a second side panel, and the container includes first and second torsion bars respectively provided at lower ends of the first and second side panels to generate torque when the first and second side panels are rotated, third and fourth torsion bars respectively provided at lower ends of the front panel and the rear panel to generate torque when the front panel and the rear panel are rotated, a first rotation support member having an L-shape, including one end coupled to a post coupling point 220 spaced apart by a predetermined distance from the lower end of the front panel, and the other end coupled to a third torsion bar at a bottom plate coupling point 210 located on a side spaced apart by a predetermined distance from an end of the bottom plate to support the rotation operation of the front panel, and a second rotation support member having an L-shape, including one end coupled to a post coupling point 220 spaced apart by a predetermined distance from the lower end of the rear panel, and the other end coupled to a fourth torsion bar at a bottom plate coupling point 210 located on a side spaced apart by a predetermined distance from an end of the bottom plate to support the rotation operation of the rear panel, in which the front panel and the rear panel are rotated around the bottom plate coupling points 210, and the top plate is completely detachably coupled to the side wall panels.

The third and fourth torsion bars are provided in a non-twisted state, while the post coupling points 220 is located directly above the bottom plate coupling points 210.

The container further includes corner support members having an L-shape, formed vertically at four corners of the bottom plate to support post P corners of the front panel and the rear panel when the container is in an unfolded state, and support four corners of the top plate when the container is in a folded state.

The container further includes a fixture fixedly coupled to the bottom plate of the container, and a rotating body fixedly coupled to the first and second side panels to be rotated together when the first and second side panels are rotated, in which one ends of the first and second torsion bars are coupled to the fixture and the other ends are coupled to the rotating body such that, when the first and second side panels are rotated, torsional elastic energy is accumulated.

The container further includes a coupling member provided on an upper surface of the top plate to be coupled with forks of a forklift.

Advantageous Effects

According to the present disclosure, with the structure described above, after the top plate of the container is removed with a forklift, the side wall panel can be easily folded simply by manpower and the height can be reduced by ¼ in the folded state such that four containers can be folded and stacked, and thus the effects of easy storage and movement of the containers are provided.

BEST MODE

Figure 1:
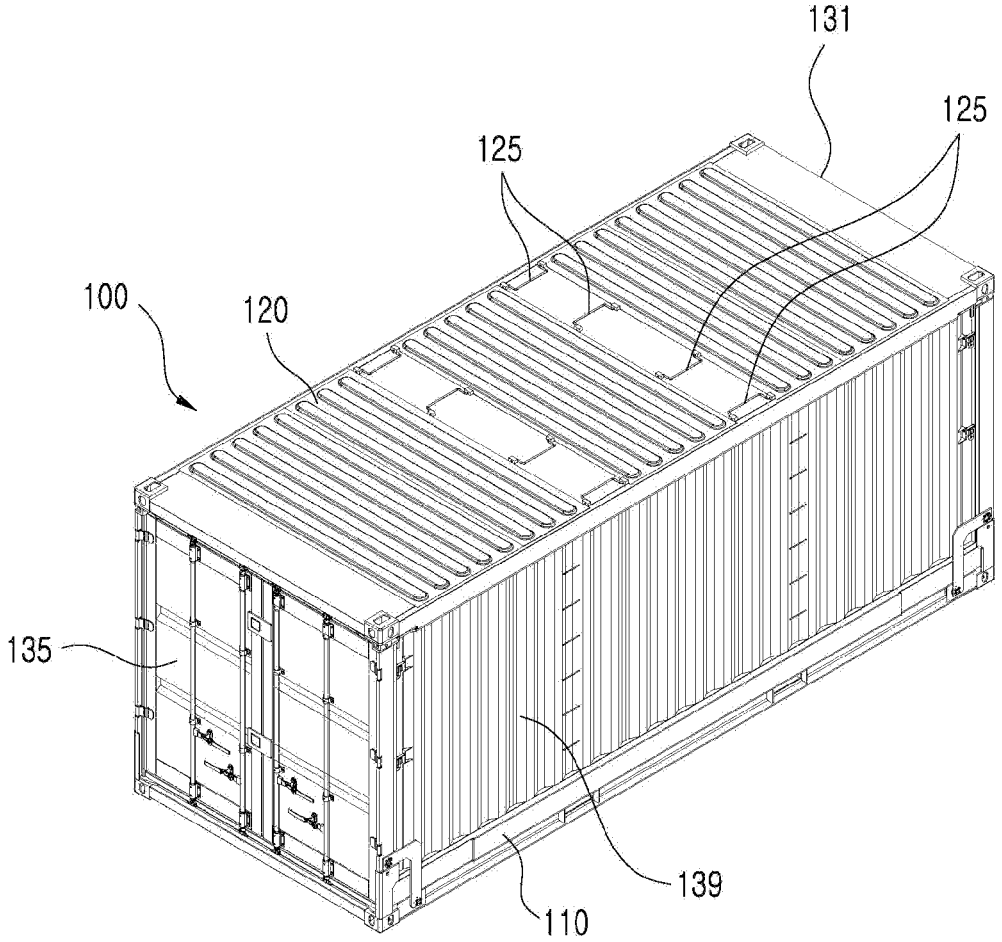
FIG. 1 illustrates an overall appearance of a foldable container according to the present disclosure.

Hereinafter, embodiments of the present disclosure will be described in detail with reference to the accompanying drawings. It should be noted that, in adding reference numerals to the constituent elements of the drawings, the same constituent elements are denoted by the same reference numerals even if they are illustrated in different drawings. In the following description of the present disclosure, a detailed description of known functions and configurations incorporated herein will be omitted when it may make the subject matter of the present disclosure rather unclear.

The objectives, specific advantages and novel features of the present disclosure will become more apparent from the following detailed description and the preferred embodiments, which are associated with the accompanying drawings. In addition, terms described herein are terms defined in consideration of functions in the present invention, which may vary according to the intention or convention of a user or an operator. Therefore, definitions of these terms should be made based on the contents throughout the present specification.

Figure 2:
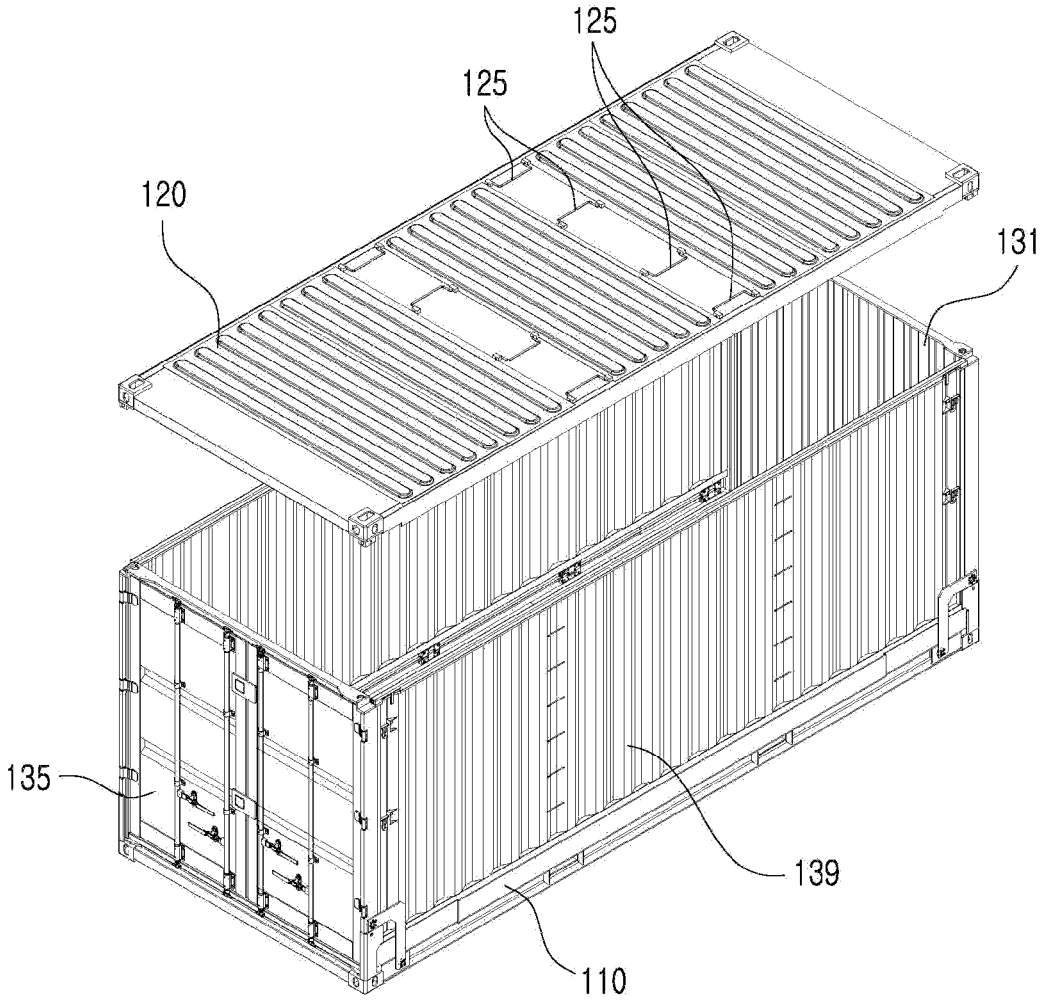
FIG. 2 illustrates the foldable container from which a top plate is removed according to the present disclosure.
Figure 3:
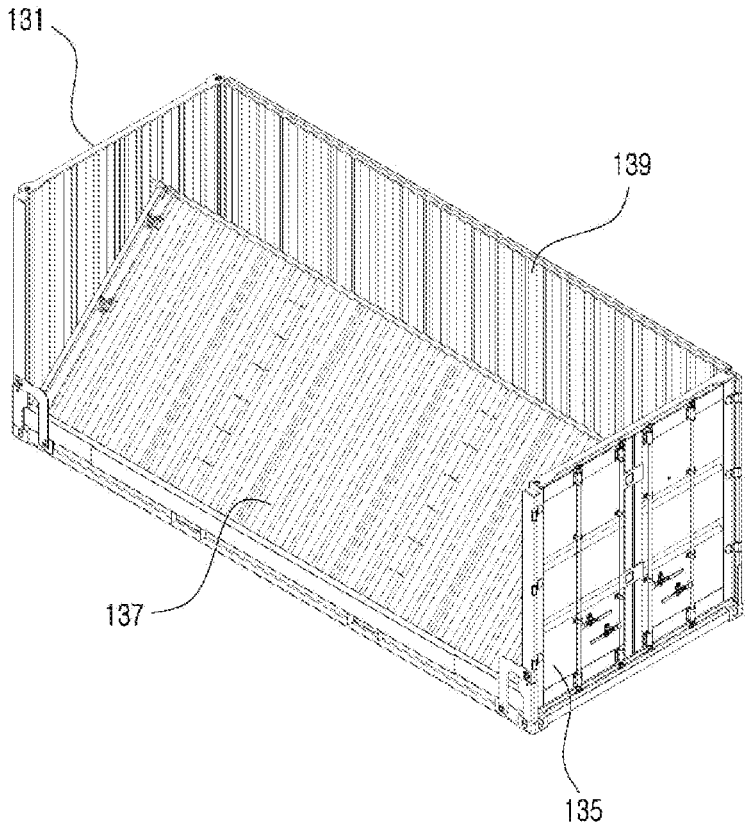
FIG. 3 illustrates a first side panel of the foldable container being folded according to the present disclosure.
Figure 4:
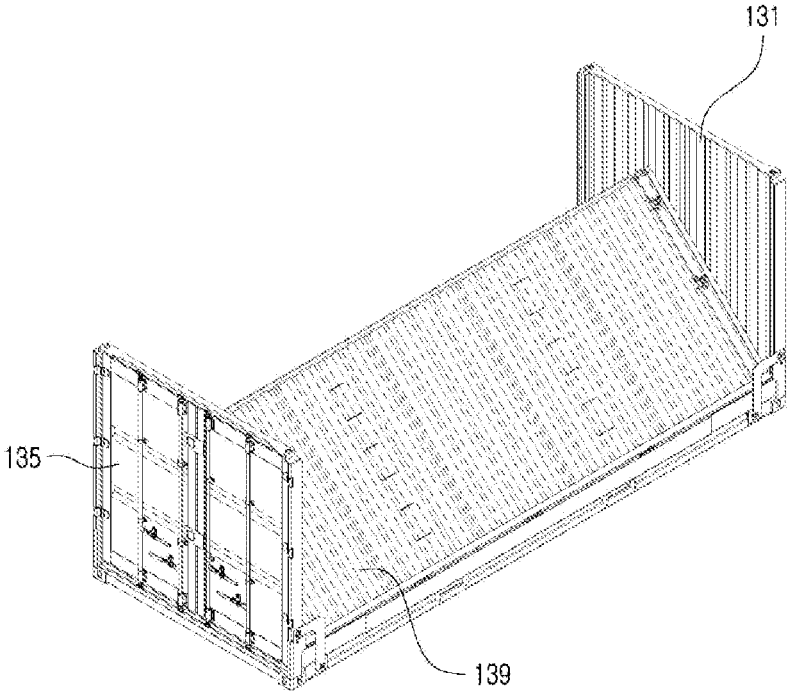
FIG. 4 illustrates a second side panel of the foldable container being folded according to the present disclosure.
Figure 5:
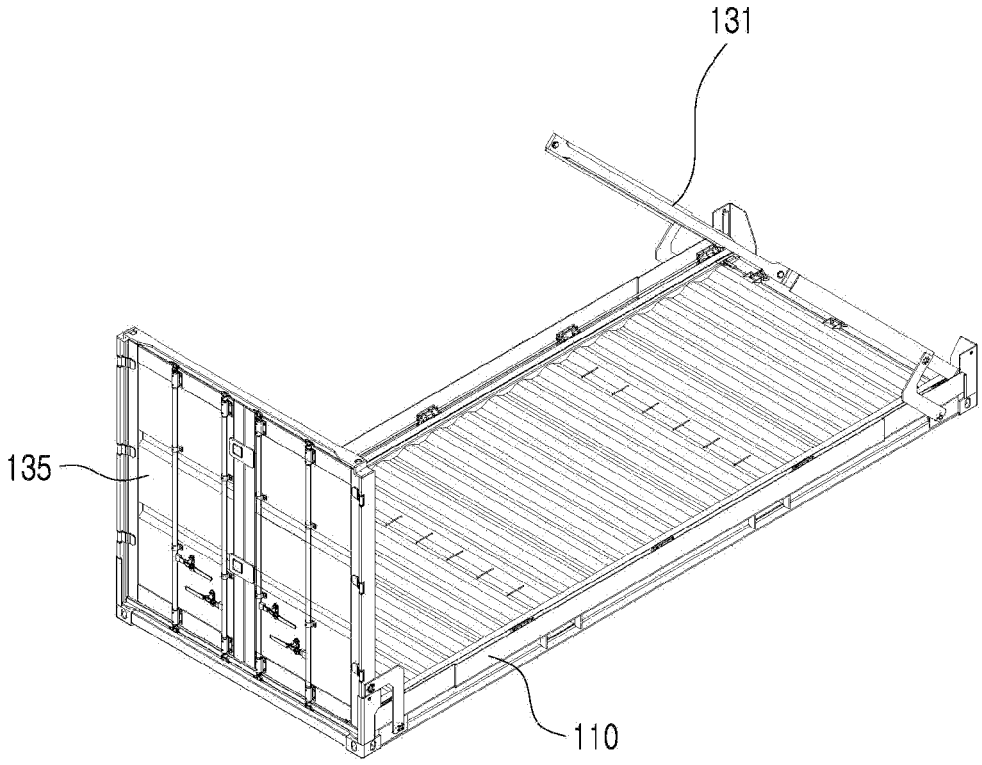
FIG. 5 illustrates a front panel of the foldable container being folded according to the present disclosure.
Figure 6:
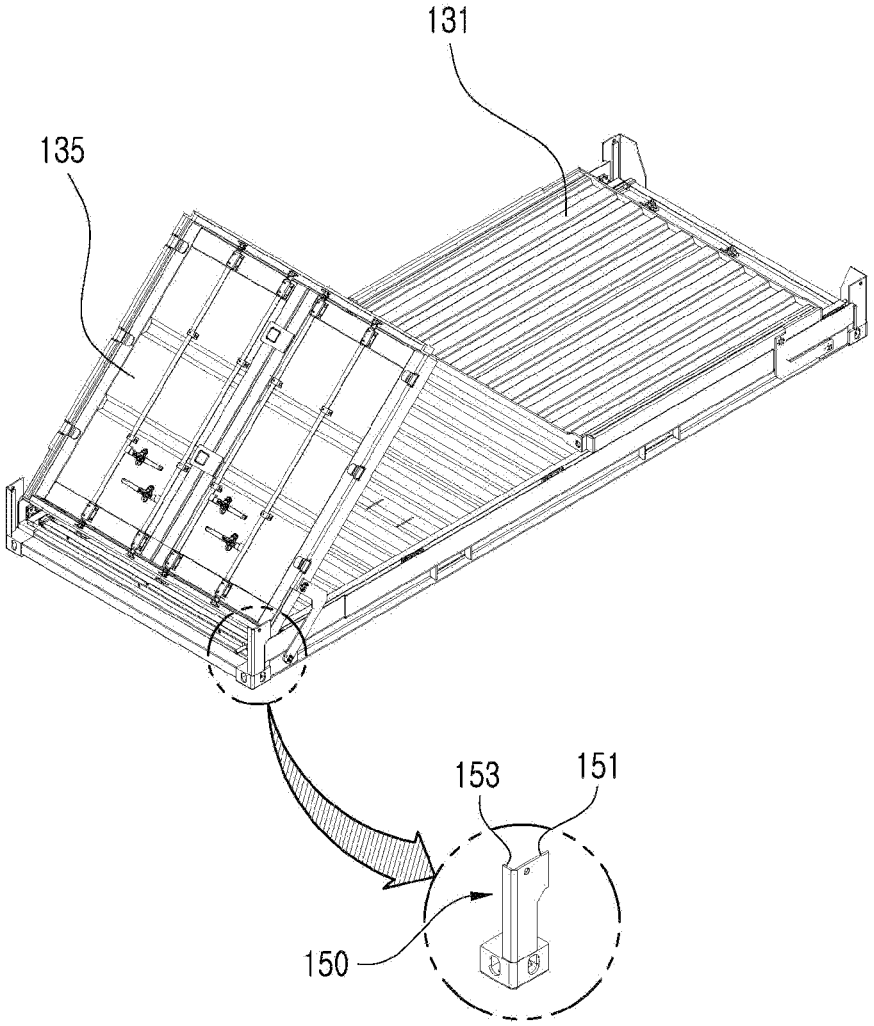
FIG. 6 illustrates a rear panel of the foldable container being folded according to the present disclosure.
Figure 7:
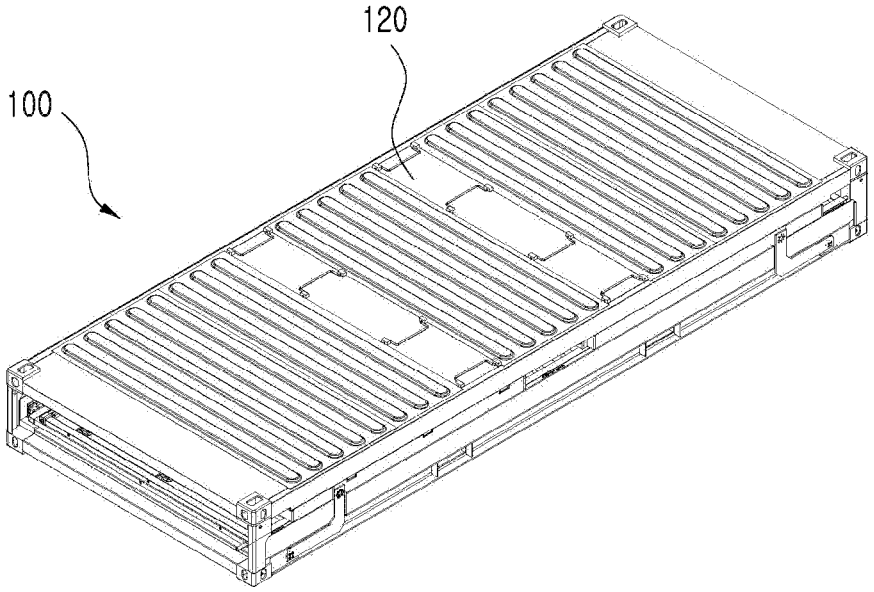
FIG. 7 illustrates the foldable container fully folded according to the present disclosure.
Figure 8:
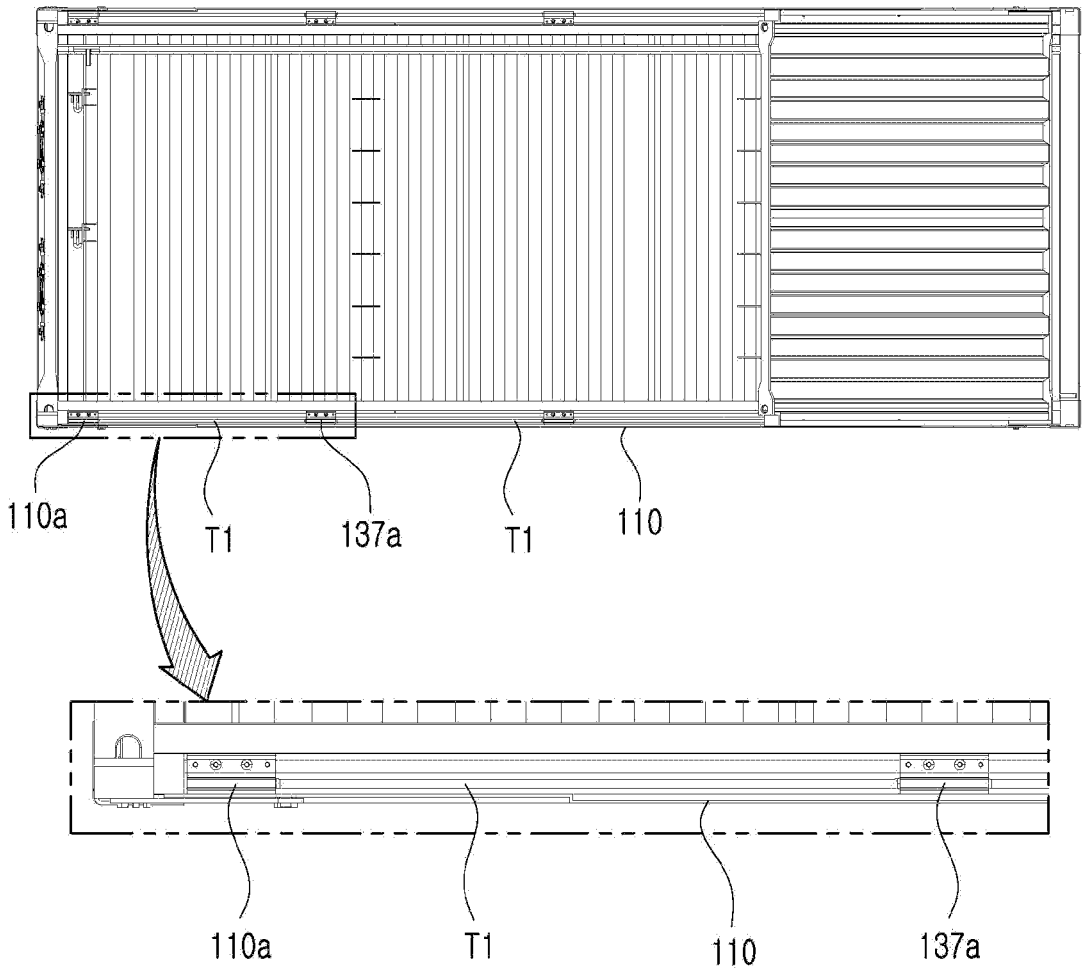
FIG. 8 illustrates a structure of a torsion bar provided in a longitudinal direction on a bottom plate of the foldable container according to the present disclosure.
Figure 9:
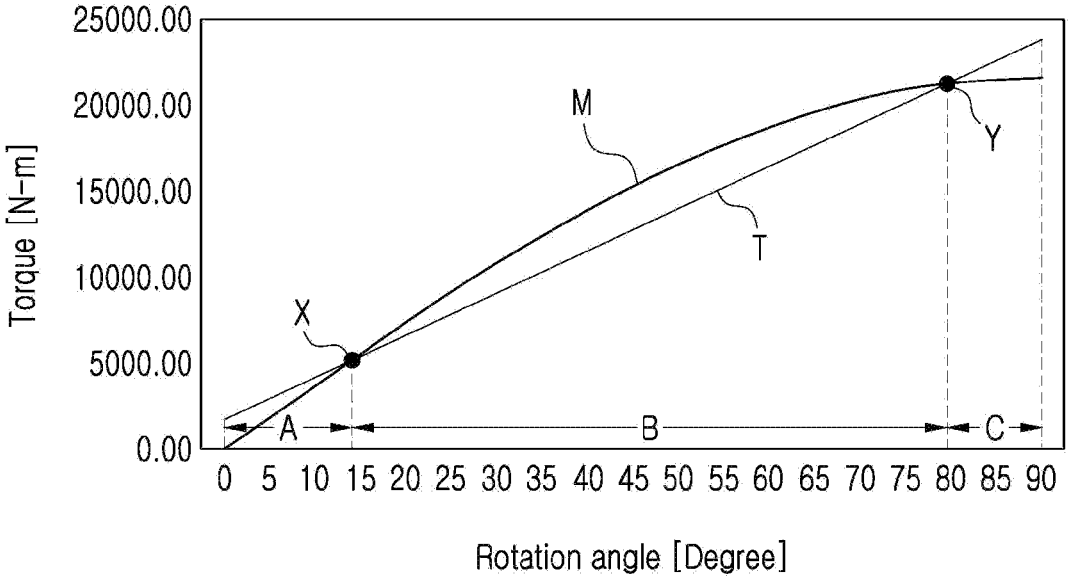
FIG. 9 is a graph showing the relative magnitudes of a moment and a torque according to the present disclosure, in which the moment is generated based on the weights of the first and second side panels of the foldable container during folding, and the torque is generated by the torsion bar.
Figure 10:
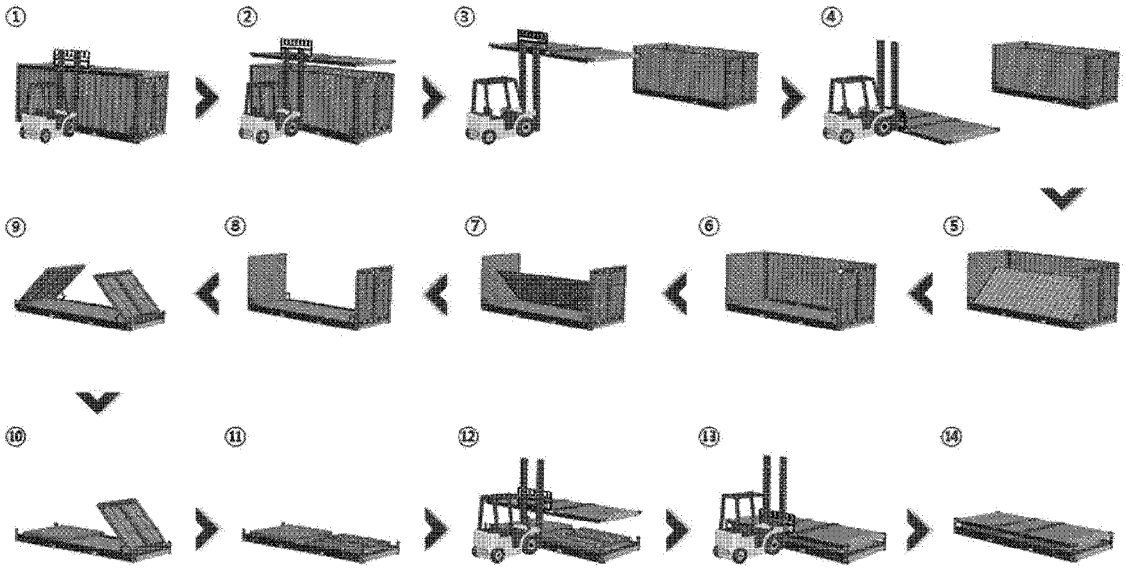
FIG. 10 illustrates the overall process of folding and unfolding the foldable container according to the present disclosure.

FIG. 1 illustrates an overall appearance of a foldable container according to the present disclosure, in which the side wall panel of the container is in a vertically unfolded state, which will be referred to herein as an "unfolded state" for convenience. FIG. 2 illustrates the foldable container from which a top plate is removed according to the present disclosure, FIG. 3 illustrates a first side panel of the foldable container being folded according to the present disclosure, FIG. 4 illustrates a second side panel of the foldable container being folded according to the present disclosure, FIG. 5 illustrates a front panel of the foldable container being folded according to the present disclosure, FIG. 6 illustrates a rear panel of the foldable container being folded according to the present disclosure, and FIG. 7 illustrates the foldable container fully folded according to the present disclosure, which will be referred to herein as a "folded state" for convenience. FIG. 8 illustrates a structure of a torsion bar provided in a longitudinal direction on a bottom plate of the foldable container according to the present disclosure, FIG. 9 is a graph showing the relative magnitudes of a moment and a torque according to the present disclosure, in which the moment is generated based on the weights of the first and second side panels of the foldable container during folding and the torque is generated by the torsion bar, and FIG. 10 illustrates the overall process of folding and unfolding the container. It is designed such that the use of a forklift is necessary only in the process of removing or lifting the top plate, while all other operations are possible with human power. Since the forklift is present anywhere in the field where containers are loaded or moved, even when there are some operations that use the forklift, it will not cause any problem in the efficiency of work.

Foldable Container Structure and Folding Method

A foldable container of the present disclosure (hereinafter, it may be referred to as "container") has a bottom plate 110, a top plate 120 spaced apart above the bottom plate 110, and a side wall panel 130 vertically installed on a side between the bottom plate 110 and the top plate 120. The side wall panel 130 includes four vertically-arranged panels, which will be referred to as a front panel 131, a rear panel 135, a first side panel 137, and a second side panel 139, respectively. Posts P for bearing the load of the container in the vertical direction are provided on edges of the rectangles of the front panel 131 and the rear panel 135, respectively.

The feature of the foldable container according to the present disclosure is that the four side wall panels 130 can be simply folded by manpower using a torsion bar provided at the lower end, while the top plate 120 is completely removed using a forklift. That is, when the side wall panel is folded by the moment due to its self weight, the torque generated from the twisting torsion bar applies a rotational force opposite to the moment due to self weight, thereby allowing the it to be folded smoothly.

First, a method for folding a container according to the present disclosure will be described.

For the container of the present disclosure, the process of lifting the top plate 120 using a forklift is performed first. A plurality of coupling members 125, to which the forks of the forklift are inserted and coupled, are provided on the top plate, that is, on an upper surface of the top plate of the container in a transverse direction. Hereinafter, the transverse direction of the container refers to the width direction of the container, and the longitudinal direction of the container refers to the direction from the front panel toward the rear panel. In addition, FIG. 2 illustrates the top plate completely lifted up by the forklift (illustration of the forklift is omitted for convenience of description). The characteristic of the present disclosure is that the top plate 120 is first completely separated from the side wall panel 130 by the forklift, as illustrated in FIG. 2. This is completely different from the related art where the folding operation is performed with the top plate remaining attached to the side wall panel. The top plate removed by the forklift is moved to the side of the container and positioned.

Then, the first side panel 137 is folded as illustrated in FIG. 3, and the second side panel 139 is folded over the first side panel 137 as illustrated in FIG. 4. According to the present disclosure, in order to fold the first and second side panels, first and second torsion bars T1 and T2 are positioned under the first and second side panels. This will be described with reference to the detailed illustration in FIG. 8. Since the first side panel and the second side panel are folded by the same principle as each other and it is also the same that four of the first and second torsion bars are arranged along the longitudinal direction of the container, only the process of folding the first side panel will be described below as an example.

Referring to FIG. 8, there is provided a fixture 110*a* that is fixedly coupled to the bottom plate 110 of the container so as not to rotate in the process of folding (or rotating) of the first side panel 137. The fixture 110*a* is fixed to a frame of the bottom plate and not rotated. In addition, there is provided a rotating body 137*a* that is fixedly coupled to the first side panel 137 and rotated together when the first side panel is rotated. In this example, the "rotation" means an operation of pivoting of the side wall panel based on the lower end in order to be folded. In addition, one end of the first torsion bar T1 is coupled by serration to the fixture 110*a* and the other end is coupled by serration to the rotating body 137*a*. When the first side panel 137 is rotated to be folded, the rotating body 137*a* is rotated, and as a result, the first torsion bar T1 is twisted and rotational elastic energy is accumulated (this is referred to as "torsion bar torque" for convenience). The torsion bar torque applies a rotational force in the direction opposite to the rotational force direction of the moment generated by the self weight of the first side panel, thereby preventing the first side panel from being suddenly folded by the self weight, while ensuring a smooth folding operation.

The principle of the rotation of the first side panel, the torque of the first torsion bar, and the like will be separately described in detail in the [Rotation Operation of Side Panel and Torsion Bar] provided below.

FIG. 5 illustrates the front panel of the foldable container being folded according to the present disclosure, and FIG. 6 illustrates the rear panel of the foldable container being folded according to the present disclosure.

According to the present disclosure, in order to fold the front and rear panels, third and fourth torsion bars T3 and T4 are positioned under the front and rear panels. Since the third torsion bar positioned under the front panel and the fourth torsion bar positioned under the rear panel have the same principle of operation during rotation, and the third torsion bar and the fourth torsion bar are the same that two are arranged along the transverse direction of the container, only the process of folding the rear panel 135 will be described below as an example. Meanwhile, the principle of the rotation of the rear panel, the torque of the fourth torsion bar, and the like will be separately described in detail in the [Rotation Operation of Rear Panel and Torsion Bar] provided below.

FIG. 7 illustrates the top plate 120 is placed by a forklift onto the top of the container in the fully folded state, which will be referred to herein as a "folded state" for convenience. In order to place the top plate 120 in the correct position in the folded state, in the present disclosure, L-shaped corner support members 150 positioned at four corners of the bottom plate 110 are adopted.

Referring to FIG. 6, the corner support members 150 are L-shaped members formed at the four corners of the bottom plate 110, and have a first support surface 151 and a second support surface 153 that are perpendicular to each other. The corner support members 150 serve to support, from the outside, the corner ends of the posts P of the front panel and the rear panel when the container is in the unfolded state, and serve to support the four corners of the top plate 120 placed on the container when the container is in the folded state.

Rotation Operation of Side Panel and Torsion Bar

The structure of the torsion bar of FIG. 8 and the graph of FIG. 9 will be described. The graph of FIG. 9 shows the moment M generated by the self weight of the container in the process of changing the rotation angle of the bottom plate 110 from 0° to 90°, and the torsional elastic energy resulting from the rotation of the first torsion bar, that is, the torsion bar torque T. In the graph, the horizontal axis represents the rotation angle of the first side panel of the container, and the vertical axis represents the torque. Referring to the graph, the relationship of the moment and the torque according to the angle in the rotation process is divided into three sections: Section A, Section B, and Section C.

Section A is a process of starting the folding operation of the side wall of the container, and in this section, the torsion bar torque T is formed to be greater than the moment M generated by the self weight of the container. This can be achieved by mounting the first torsion bar T1 that is twisted at a predetermined angle in advance, with the first side panel 137 being in stand-up position. That is, the first torsion bar is twisted by a predetermined angle (about 7° in the present disclosure) in advance in the direction in which the first torsion bar will be twisted when the first side panel is rotated (This will be referred to herein as "preliminary torque" for convenience). The reason for doing this is to ensure the stability of the folding process. That is, this is to prevent the first side panel 137 from being suddenly rotated and collapsed from the stand-up state. In this example, in order to fold the first side panel, it is necessary to apply a force from the outside, and to be specific, the force needs to be applied up to an angle corresponding to the point X in the graph. In the present disclosure, by selecting a torsion bar of an appropriate specification, and the like, the amount of necessary force is appropriately adjusted so as to allow a rotation up to the X point by pushing only with human force.

Section B is a section in which the moment M due to the self weight of the first side panel is greater than the torsion bar torque T, and is a section in which the folding operation is performed by the self weight without requiring a separate external torque. However, the smaller the difference between the moment M and the torsion bar torque T in this section (the smaller the size of the arrow in the B section of the graph), the smoother the first side panel folds.

Section C is a process in which the rotation operation of the first side panel is finished, and in this section, the torsion bar torque T is slightly larger than the moment M generated by the self weight. That is, while it requires additional external force to achieve the fully folded state, because the additional external force is small, it is sufficient for a human to press the first side panel from above.

According to the present disclosure, the torque value of the torsion bar is appropriately selected in consideration of the magnitude of the moment value generated by the self weight of the side wall panel, such that the external power (torque) is required only at the beginning and the end of the folding operation, and the size of the required external power is also sufficiently adjustable by human power.

According to the present disclosure, with the top plate removed, the first side panel maintains the vertical position in a self-supporting state due to the preliminary torque of the torsion bar itself. Then, it requires only a little external force to rotate it to the X point, after which the rotation operation is automatically performed by the self weight of the side panel. Then, it requires a human to apply the external force only in the last predetermined section of the rotation operation to make the folded state. In the present disclosure, the points X and Y were appropriately selected in order to provide the necessary preliminary torque while reducing Section B, that is, reducing the size of the arrow.

Rotation Operation of Rear Panel and Torsion Bar

Figure 11:
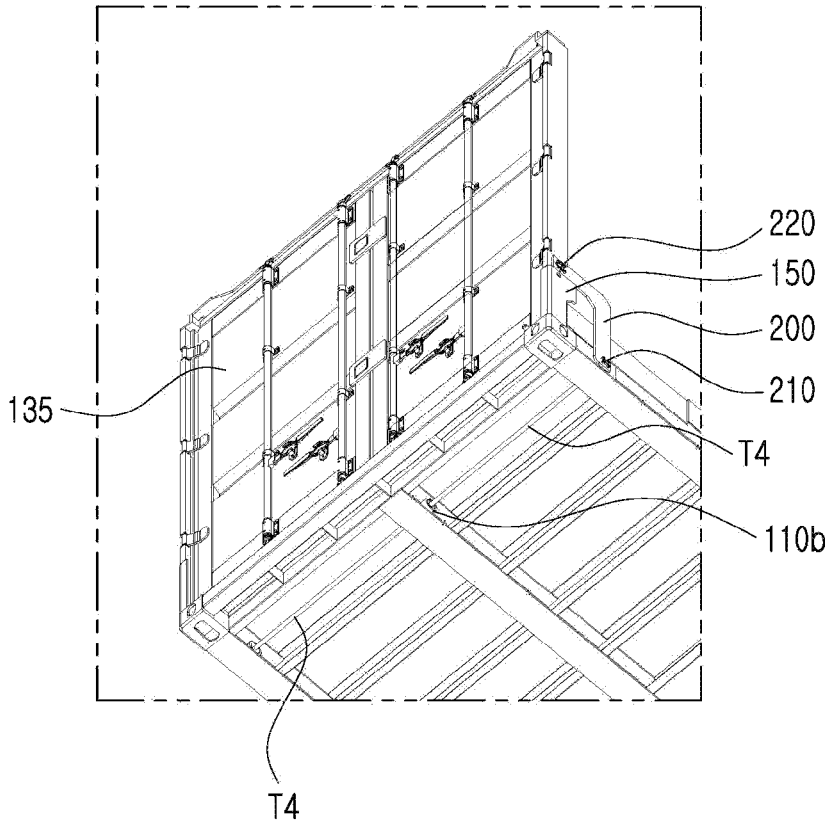
FIG. 11 illustrates a partial lower portion of the bottom plate of the foldable container according to the present disclosure.
Figure 12:
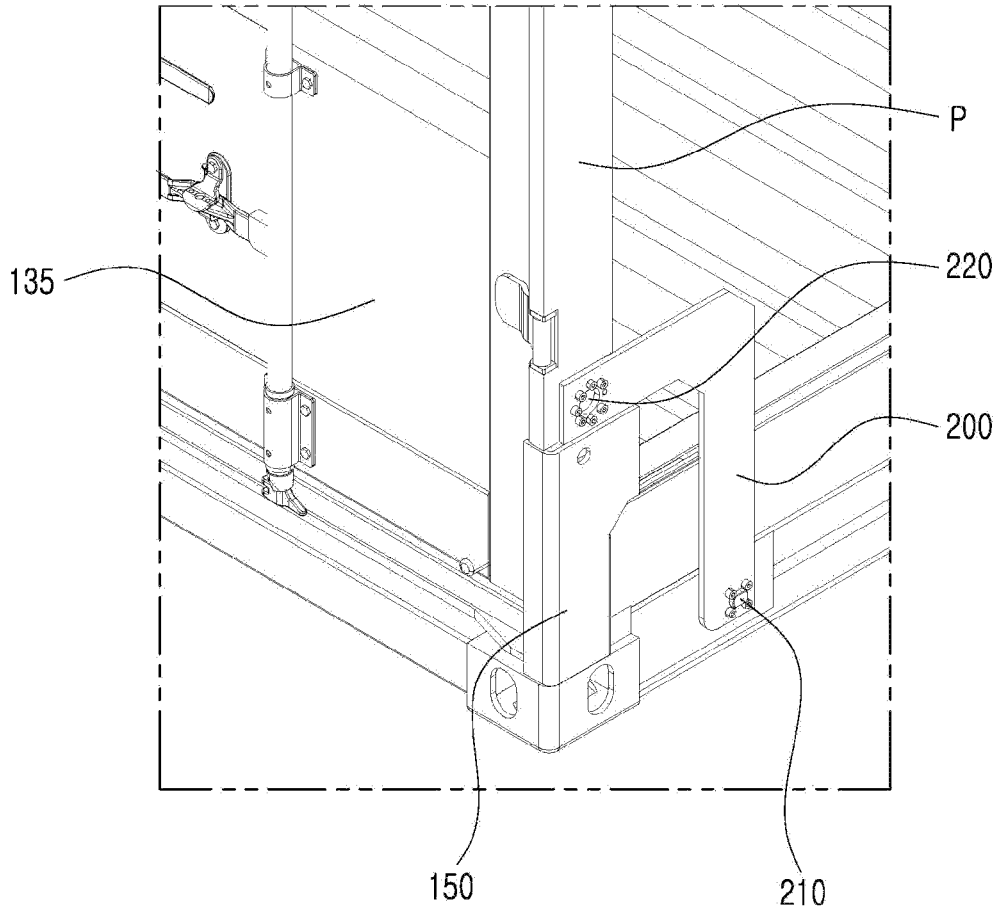
FIG. 12 illustrates a rotation support member of the foldable container according to the present disclosure.
Figure 13:
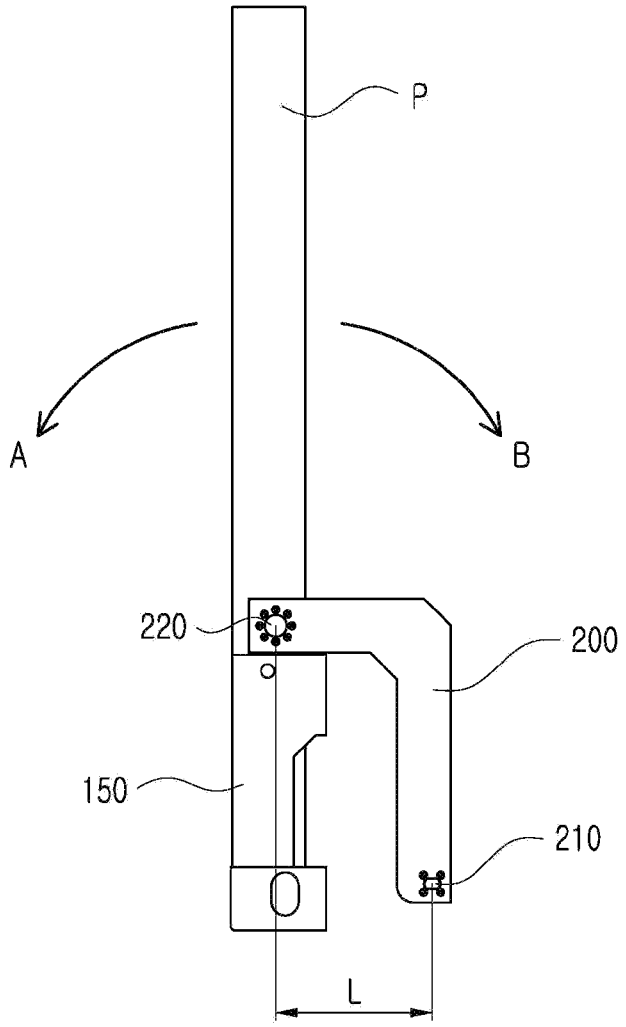
FIGS. 13 and 14 are explanatory diagrams illustrating the operating principle of the rotation support member and the torsion bar of the foldable container according to the present disclosure.
Figure 14:
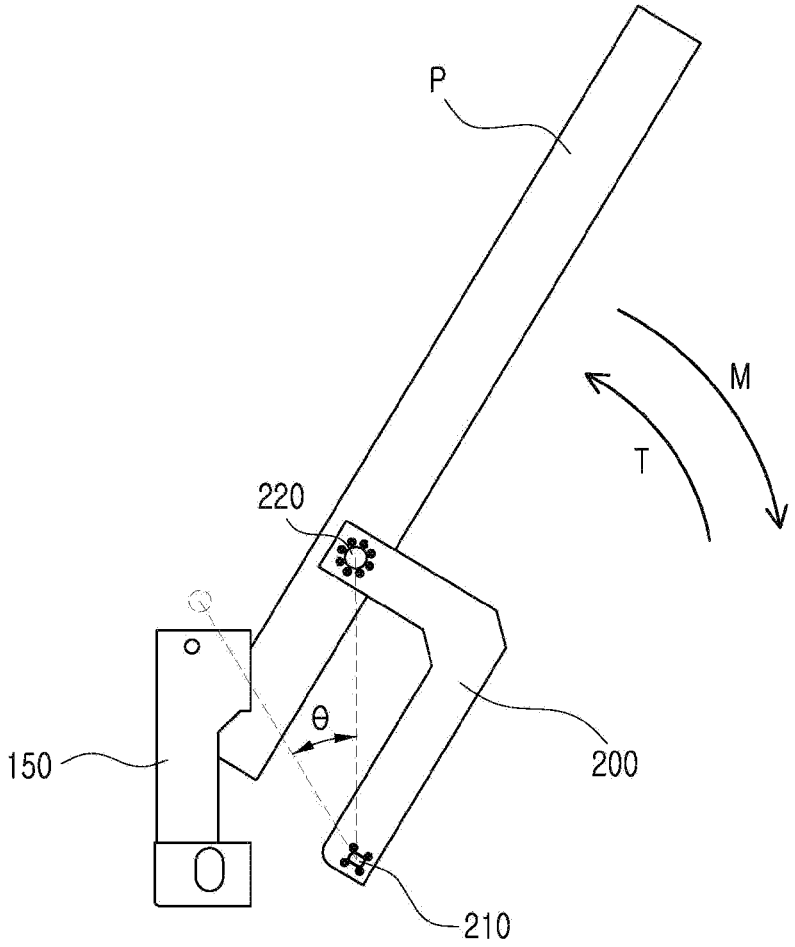

FIG. 11 illustrates a partial lower portion of the bottom plate of the foldable container according to the present disclosure, and illustrates the lower portion adjacent to the rear panel 135. FIG. 12 illustrates a rotation support member according to the present disclosure, and FIGS. 13 and 14 are explanatory diagrams illustrating the operating principle of the rotation support member and the torsion bar.

In general, since most of the vertical load of the container is born by the post (P in FIG. 12) positioned on the side of the front panel 131 and the rear panel 135, the strength of the front panel 131 and the rear panel 135 is important, and therefore, the load they receive is much greater than that of the first and second side panels. Therefore, in order to enable the rotation operation of the front panel and the rear panel by human force, the torsion bar provided for this and its arrangement structure are important. According to the present disclosure, in order to rotate the front panel 131 and the rear panel 135, the third and fourth torsion bars T3 and T4 are provided. Since the front panel 131 and the rear panel 135 are the same as each other in both the rotation operation and the principle, the rear panel 135 and the fourth torsion bar T4 will be described below as an example.

Two of the fourth torsion bars T4 are arranged side by side on the bottom plate 110 of the container in the transverse direction, and only one of them is illustrated in FIG. 11. One end of the fourth torsion bar T4 is coupled by serration to a fixed coupling part 110*b* fixed to the frame of the bottom plate 110, and the other end of the fourth torsion bar is coupled to a rotation support member 200 while passing through the outer frame of the bottom plate.

The rotation support member is an L-shaped member, with one end being coupled to a post coupling point 220 at the post P spaced apart from the lower end of the rear panel by a predetermined distance, and the other end being coupled to the fourth torsion bar T4 at a bottom plate coupling point 210 located on the side spaced apart from the end of the bottom plate by a predetermined distance (it is fixedly coupled using a separate connecting member between the fourth torsion bar and the other end). The corner of the post P is supported from the outside by the corner support member 150.

As described above, the rear panel and the front panel are subjected to a greater load than the side panel, while the width of the container in the transverse direction is smaller than the length in the longitudinal direction, and accordingly, since the third and fourth torsion bars must have higher torsional torque, in consideration of the lifespan of the third and fourth torsion bars and also the load of the front panel and the rear panel, the present disclosure adopts the L-shaped rotation support member for their rotation operation.

Referring to the rotation operation of the rear panel 135, the rotation operation is performed based on the third torsion bar located on the side spaced apart from the end of the bottom plate by a predetermined distance as the reference axis, which is different from the rotation of the side panel that is performed based on the axis located immediately thereunder. The rotation support member has the following roles and functions.

Ensuring Stability

In the description of the rotation operation of the side panel, it is described that the first and second torsion bars twisted by a predetermined angle in advance are mounted to provide the "preliminary torque" in order to ensure stability (to prevent the side panel from being suddenly rotated and collapsed from the stand-up state).

However, stability is ensured by the rotation support member 200 without requiring the "preliminary torque" to be applied to the fourth torsion bar T4 involved in the rotation of the rear panel.

That is, in FIG. 13, the rear panel is supported by the corner support member 150 supporting the outer corner of the lower end thereof, so that the rotation in the direction of the arrow A is constrained, and further, the rotation in the direction B is also constrained by the rotation support member 200 and its self load (that is, in the absence of the rotation support member, rotation occurs in the direction B). For the side panel, the preliminary torque is applied to the torsion bar to prevent the inward folding operation, but for this rear panel, even when the preliminary torque is not applied to the torsion bar, the rotation operation is kept from occurring, thereby ensuring stability. In other words, in order for the rear panel 135 to be rotated inward, it requires to apply the external force up to the point where the post coupling point 220 is located directly above the bottom plate coupling point 210, and therefore, the rear panel is maintained in a stable state unless the external force is applied (FIG. 14). In the actual operation of folding the rear panel, the rear panel is rotated by pushing from the outside by the power of a human by the angle θ shown in FIG. 14. When the rear panel is rotated beyond the angle shown in FIG. 14, the rear panel is gently folded by the mutual relationship between the moment M by the self weight of the rear panel and the torsion bar torque T by the fourth torsion bar, which has already been described with reference to the folding operation of the side panel.

Ensuring Durability of Torsion Bar

Since it is difficult to expect the effect of torsional elastic energy any more when the twist angle of the torsion bar exceeds the point where plastic deformation occurs, the torsion bar should be twisted only at an angle below which plastic deformation does not occur, and even at an angle at which plastic deformation does not occur, it is still advantageous to prevent excessive twisting in consideration of the lifespan.

It has been described that according to the present disclosure, stability is ensured by the rotation support member 200 even without the "preliminary torque" applied to the fourth torsion bar of the container. This has the effect of reducing the amount of twist of the fourth torsion bar as a result. For example, when a 7° torsion angle is provided in the initial state (side panel stand-up state) to provide the preliminary torque to the side panel, in the folded state in which the side panel is completely rotated by 90°, there is the effect that the first and second torsion bars have a torsion angle of 97°.

Meanwhile, according to the present disclosure, the fourth torsion bar of the rear panel does not have a preliminary torque due to the existence of the rotation support member 200, and the fourth torsion bar is in a state where there is no torsion in the state illustrated in FIG. 14 (in this state, the post coupling point 220 is located directly above the bottom plate coupling point 210). In this state, when the rear panel is completely rotated and folded, the twist angle of the fourth torsion bar is (90−θ), and the maximum twist angle is significantly reduced. This leads to the effect of increasing the life of the fourth torsion bar.

The rotation support member is provided equally on the front panel and the rear panel, and includes a first rotation support member coupled to the front panel and a second rotation support member coupled to the rear panel.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

What is claimed is:

1. A foldable container comprising a bottom plate, a top plate, and side wall panels provided between the bottom plate and the top plate, wherein the side wall panels include a front panel, a rear panel, a first side panel, and a second side panel, and the container comprises:

first and second torsion bars respectively provided at lower ends of the first and second side panels to generate torque when the first and second side panels are rotated;

third and fourth torsion bars respectively provided at lower ends of the front panel and the rear panel to generate torque when the front panel and the rear panel are rotated;

a first rotation support member having an L-shape, including one end coupled to a post coupling point (220) spaced apart by a predetermined distance from the lower end of the front panel, and the other end coupled to the third torsion bar at a bottom plate coupling point (210) located on a side spaced apart by a predetermined distance from an end of the bottom plate to support the rotation operation of the front panel; and a second rotation support member having an L-shape, including one end coupled to a post coupling point (220) spaced apart by a predetermined distance from the lower end of the rear panel, and the other end coupled to the fourth torsion bar at a bottom plate coupling point (210) located on a side spaced apart by a predetermined distance from an end of the bottom plate to support the rotation operation of the rear panel, wherein the front panel and the rear panel are rotated around the bottom plate coupling points (210), and the top plate is completely detachably coupled to the side wall panels.

2. The foldable container according to claim 1, wherein the third and fourth torsion bars are provided in a non-twisted state, while the post coupling points (220) is located directly above the bottom plate coupling points (210).

3. The foldable container according to claim 2, further comprising corner support members having an L-shape, formed vertically at four corners of the bottom plate to support post P corners of the front panel and the rear panel when the container is in an unfolded state, and support four corners of the top plate when the container is in a folded state.

4. The foldable container according to claim 2, further comprising:

a fixture fixedly coupled to the bottom plate of the container; and a rotating body fixedly coupled to the first and second side panels to be rotated together when the first and second side panels are rotated, wherein one ends of the first and second torsion bars are coupled to the fixture and the other ends are coupled to the rotating body such that, when the first and second side panels are rotated, torsional elastic energy is accumulated.

5. The foldable container according to claim 2, further comprising a coupling member provided on an upper surface of the top plate to be coupled with forks of a forklift.

6. The foldable container according to claim 1, further comprising corner support members having an L-shape, formed vertically at four corners of the bottom plate to support post P corners of the front panel and the rear panel when the container is in an unfolded state, and support four corners of the top plate when the container is in a folded state.

7. The foldable container according to claim 1, further comprising:

a fixture fixedly coupled to the bottom plate of the container; and a rotating body fixedly coupled to the first and second side panels to be rotated together when the first and second side panels are rotated, wherein one ends of the first and second torsion bars are coupled to the fixture and the other ends are coupled to the rotating body such that, when the first and second side panels are rotated, torsional elastic energy is accumulated.

8. The foldable container according to claim 1, further comprising a coupling member provided on an upper surface of the top plate to be coupled with forks of a forklift.

* * * * *